United States Patent [19]

Wombold

[11] Patent Number: 4,702,387

[45] Date of Patent: Oct. 27, 1987

[54] CONTAINER AND PLASTIC CLOSURE THEREFOR

[75] Inventor: Harry A. E. Wombold, New Vienna, Ohio

[73] Assignee: Packaging Resources Inc., New Vienna, Ohio

[21] Appl. No.: 933,991

[22] Filed: Nov. 24, 1986

[51] Int. Cl.[4] ..... B65D 17/34

[52] U.S. Cl. ..... 220/270

[58] Field of Search ..... 220/268-273; 215/254

[56] References Cited

U.S. PATENT DOCUMENTS

| | | | |
|---|---|---|---|
| Re. 29,850 | 11/1978 | Labarre | 222/541 |
| 3,281,007 | 10/1966 | Dorosz . | |
| 3,407,957 | 10/1968 | Robinson . | |
| 3,415,404 | 12/1968 | Robinson . | |
| 3,415,412 | 12/1968 | Robinson et al. . | |
| 3,434,620 | 3/1969 | Laurizio | 220/27 |
| 3,499,572 | 3/1970 | Ruekberg | 220/54 |
| 3,532,248 | 10/1970 | Ruekberg | 220/270 |
| 3,927,795 | 12/1975 | Robinson | 220/269 |
| 4,030,630 | 6/1977 | Yealy | 220/258 |
| 4,171,062 | 10/1979 | Allen et al. | 220/270 |
| 4,210,618 | 7/1980 | Piltz et al. | 264/130 |
| 4,256,239 | 3/1981 | Yamaguchi et al. | 220/270 |
| 4,267,937 | 5/1981 | Piltz et al. | 220/267 |
| 4,324,342 | 4/1982 | Yamaguchi et al. | 220/268 |
| 4,360,121 | 11/1982 | Helms | 220/270 |
| 4,380,303 | 4/1983 | Allen et al. | 220/276 |
| 4,442,949 | 4/1984 | Dwinell et al. | 220/270 |
| 4,501,372 | 2/1985 | Hansen | 215/247 |

*Primary Examiner*—George T. Hall

*Attorney, Agent, or Firm*—Roger S. Dybvig

[57] ABSTRACT

A full panel pull-out plastic closure is provided having an outer rim attachable to the brim of a composite container, a center panel connected to the outer rim by a thin web, and a pulling device connected to the center panel including a relatively rigid pedestal projecting upwardly from the center panel adjacent its outer periphery and a flexible pull strap forming a pull ring connected to the pedestal. The pedestal has an outwardly projecting foot extending outwardly of the points of connection of the pull strap thereto. The web is connected to the outer rim intermediate the proximal and distal ends thereof.

17 Claims, 7 Drawing Figures

CONTAINER AND PLASTIC CLOSURE THEREFOR

SUMMARY OF THE INVENTION

This invention relates to a container and a plastic closure therefor. More particularly, the closure of this invention is of the type known as a "full panel pull-out" easy-opening closure which is made in one piece from molded plastic. The closure is especially adopted for use with composite containers but may also be used with plastic, metal or glass containers. (As those familiar with the art will be aware, the terminology "composite container" refers to a container having a tubular body formed from a laminate of one or more layers of paperboard or the like material and one or more layers of plastic film and/or metal foil. Such containers are usually closed at their bottom ends by double-seamed metal ends.)

A "full panel pull-out" closure is one in which the entire center of the closure is pulled away from the closure rim in one unbroken piece. This may be contrasted with a so-called "spiral pullout" closure which has score lines that bound an arcuate area along the outer margin of a center panel to be removed so that, when a pull ring or the like is pulled upwardly from the closure, a spiral ribbon of plastic is first removed from the rim of the closure. This type of closure has not met with widespread consumer acceptance.

A reliable, easy-opening, full panel pull-out plastic closure suitable for use on various types of containers, and especially a wide-mouthed container of size 211 and larger, including composite containers, has been sought for many years. Such a closure must be capable of being hermetically sealed to its associated container body. It must also have sufficient integrity to withstand the abuses incurred in handling, storage, and shipping, yet be constructed so that its center panel can be easily removed by the consumer. Further, the manner in which the closure is opened and the nature of its attachment to a container body must be such that the forces applied to remove the closure will not cause the closure rim to become detached from the container body or to cause the composite container body to delaminate. The closure must also be so constructed that the forces needed to open the closure do not cause the pulling device, such as a finger ring or tab, from breaking loose before the closure is fully opened.

Full panel pull-out closures are disclosed in U.S. Pat. No. Re. 29,850, granted to LaBarre on Nov. 28, 1978, a reissue of U.S. Pat. No. 3,459,315, granted Aug. 5, 1969. A modified form of the closure shown in FIG. 1 thereof has been successfully used with small-mouthed glass jars for containing vegetable oil. So far as known, the use of such closures has been limited to the small-mouthed glass containers. Such closures are not subject to the abuses of closures for composite containers, which are much more subject to distortion because of the relatively high flexibility of a composite container body as compared to a glass container. Other full panel pull-out closures that have been suggested are shown in U.S. Pat. Nos. 3,415,404, and 3,415,412.

A substantial deterrent to the provision of a composite container assembly with a full panel pull-out closure has been the difficulty of securely attaching a plastic closure to a composite container to obtain a liquid-tight and leak-proof seal. Several adhesives and various configurations of the mating parts of the containers and the closures have been proposed but have not been found successful. Techniques have recently been developed for attaching plastic closures to composite container bodies by spin welding. Spin welding can be used to connect the closures to the container bodies with greater security than has been possible by the use of adhesives. However, if the attachment between the composite container body and the closure is sufficiently strong or secure to provide an adequate seal and to satisfactorily resist the pulling away of the closure rim from the container body when removing the center panel of the closure, the problem arises that the container body will delaminate under the applied pulling forces. Spin welding, which involves rapid spinning of the closure relative to the container body, ends abruptly when welding has occurred and creates other abuses to which the closure must be resistant.

An object of this invention is to provide a one-piece, plastic, full panel pull-out closure that may be securely attached to the brim of a container body and remain attached and sealed to the brim of the container body while the center portion of the closure is being removed.

A further object of this invention is to provide a closure for a composite container that may be securely attached to a composite container body, that has a connection between its center panel and its outer rim that is sufficiently strong to withstand abuses incurred in assembly onto the container body, storage, shipping, and handling, and is openable by removal of its center panel without either detaching the closure rim from the container body or delaminating the container body.

In accordance with the present invention, a one-piece, molded plastic closure is provided having an outer rim attachable to the brim of a composite container, a center panel connected to the outer rim by a thin web, and a pulling device connected to the center panel comprising a relatively rigid pedestal projecting upwardly from the center panel and a flexible strap connected to the top of the pedestal. The flexible strap preferably forms a pull ring s that it may easily be grasped by the fingers. The pedestal is located adjacent an outer marginal portion of the center panel and has outwardly projecting foot portions that transmit pulling forces manually applied by pulling on the strap to the center panel, thereby pulling on and distorting the shape of the center panel whereupon shearing and tensional forces are applied to the web in order to initiate severing of the web. The pedestal can comprise a single relatively rigid body projecting upwardly from the center panel or it may comprise a pair of mutually closely spaced, relatively rigid posts.

For use with a composite container, the outer rim of the closure has inner and outer walls connected by a top wall and defining a downwardly opening peripheral channel for snugly receiving the brim of the composite container body, to which it is spin welded. The outer and inner rim walls are chamfered to help guide the container body and the rim together during assembly. In accordance with this invention, to avoid accidental removal of the rim or delamination of the composite container body when attempting to pull away the center panel, the web is located intermediate the proximal and distal ends of the inner wall of the rim. Briefly, the web preferably merges with the inner surface of the inner wall at a location just shortly above the level of the chamfered surface of the inner wall.

Another object of this invention is to provide an improved container assembly comprising a container body and a securely attached closure of this invention. Still another object of this invention is to provide an improved one-piece plastic closure and a composite container assembly wherein the closure is attached to the container body by spin welding.

Other objects and advantages will become apparent from the following description and the drawing.

BRIEF DESCRIPTION OF THE DRAWINGS

FIG. 7 is similar to FIG. 2 but on a larger scale.

DETAILED DESCRIPTION

Figure 1:
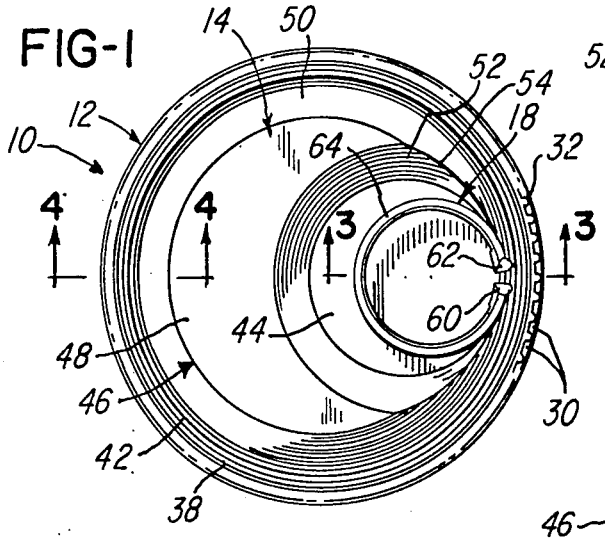
FIG. 1 is a top plan view of a closure of this invention atop a container which is concealed in FIG. 1 by the closure itself, phantom lines replacing repetitive surface features.

Referring to the drawings in greater detail, a closure of the present invention is identified in FIG. 1 by the reference number 10. Closure 10 comprises a cylindrical, container-attaching outer rim, generally designated 12, a center panel, generally designated 14, and a thin walled, circular, ring-like, relatively easily ruptured web 16 that holds the center panel within the outer rim 12. Mounted on top of the center panel 14 is a container opening device, generally designated 18, that is manipulable to sever the web 16 so that the center panel 14 may be removed.

Figure 3:
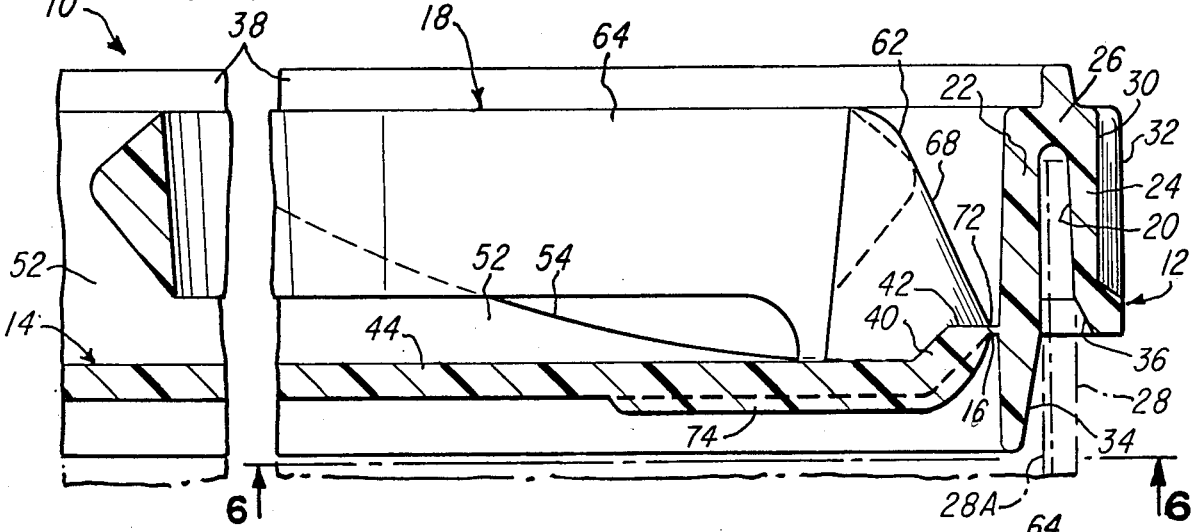
FIG. 3 is a greatly enlarged and fragmentary section view of the closure taken substantially along the line 3—3 of FIG. 1, a fragment of the container, which did not appear in FIG. 1, being shown in phantom in FIG. 3.
Figure 4:
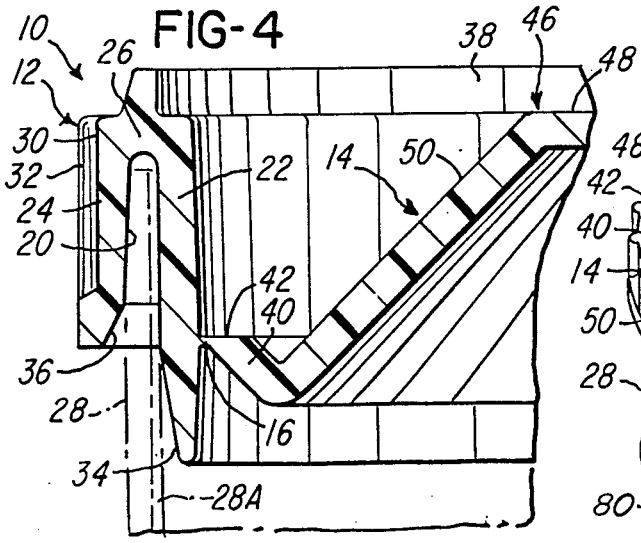
FIG. 4 is a greatly enlarged and fragmentary section view taken substantially along the line 4—4 of FIG. 1, the container again being shown in phantom.

As appears in FIGS. 3 and 4, the outer rim 12 has an inverted U-shape in cross-section and is formed with a downwardly-opening channel 20 located between a cylindrical, substantially vertical, inside wall 22 and a cylindrical, substantially vertical, outside wall or skirt 24 and closed at its upper end by a circularly extending, substantially horizontal top wall 26 that spans the upper or proximal ends of the inner and outer walls 22 and 24. In use, the annular channel 20 snugly receives and is substantially filled by the upper brim of a tubular container body 28 as indicated by phantom lines in FIGS. 3 and 4.

The outer wall or skirt 24 is provided throughout its circumference with a number of peripherally spaced, upwardly-opening grooves 30 effective to form vertically extending lugs 32 therebetween to facilitate a driving connection to the closure 10 for spin welding purposes. To assist in guiding the brim of the container body 28 into the annular channel 20 during assembly, the lower or distal end of the inside wall 22 has an inwardly tapering chamfer 34 and the lower or distal end of the outside skirt 24 has an outwardly sloping chamfer 36.

The outer rim 12 is preferably provided with a conventional stacking rib 38 projecting upwardly from the rim top wall 26 and overlying the annular channel 20.

With continued reference to FIGS. 3 and 4, the center panel 14 has an upwardly and outwardly sloping peripheral wall 40 having a planar, circumferentially extending, horizontal top surface 42 which is coplanar with the top surface of the web 16, and the web 16 merges into the uppermost and outermost edge of the peripheral wall 40. Peripheral wall 40 extends around a central panel body portion that includes a planar, horizontal, recessed panel base 44 that is circular in plan. The central panel portion could be entirely planar. However, the central panel portion of the closure 10 illustrated in the drawing has a raised body portion, generally designated 46, to provide more space within the assembled container for its contents, and the panel base 44 has a radius shorter than the radius of the entire central body portion, the center of the panel base 44 being so located that portion of its outer edge tangentially merges with the outer periphery of the central panel body portion (at the base of the peripheral wall 40).

The raised body portion 46 has a planar top wall 48, which is crescent-shaped when viewed from above, bounded by a circularly convexly extending outer wall 50 that, as shown best in FIG. 4, slopes upwardly and inwardly from the base of the peripheral outer wall 40, and by a circularly concavely extending inner wall 52 that slopes inwardly and upwardly from the panel base 44. Inner wall 52, the upper edge of which is designated 54, varies in height from the same height as the raised center panel portion 46 to no height at all along a short arcuate portion of the panel base 44 where it merges into the innermost and lowermost margin of the sloping peripheral wall 40. Thus, the inner wall 52 does not extend completely around the panel base 44, it being interrupted at the radially outermost margin of the panel base 44.

Figure 2:
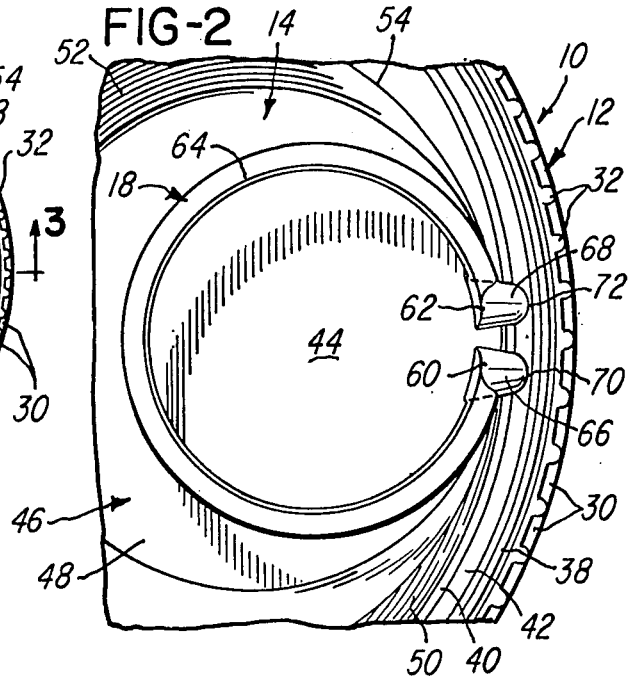
FIG. 2 is an enlarged, fragmentary top plan view of the closure.

Panel base 44 is circular in plan, as viewed in FIGS. 1 and 2, with a horizontal extent greater than the horizontal extent of the container opening device 18 so that one may easily manipulate the opening device 18 without interference from the surrounding portions of the center panel 14. The entire center panel 14 and the opening device 18 are no higher than the upper surface of the top wall 26 of the outer rim 12. That the entire center panel 14 and the opening device 18 extend no higher than the top surface of the top wall 26 of the outer rim 12 is advantageous in handling of mass-produced closures 10 will be appreciated by those familiar with the art.

Figure 5:
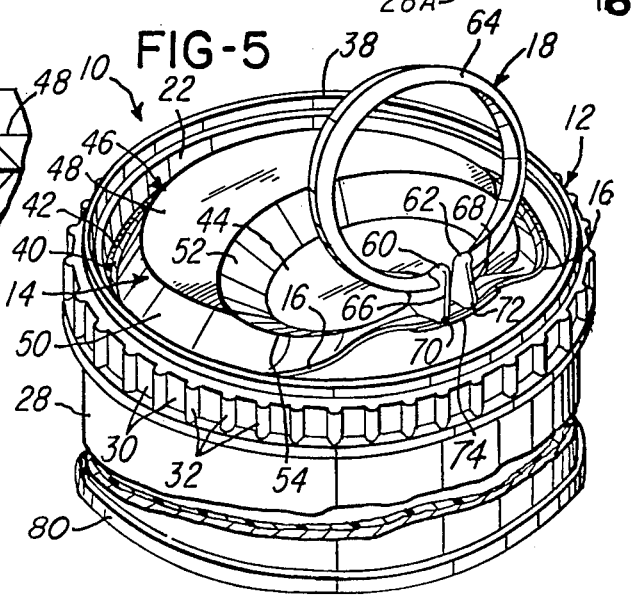
FIG. 5 is a fragmentary isometric view of a container of this invention showing the closure as it would appear while being opened.

With reference to FIGS. 2, 3 and 5, the opening device 18 comprises a pedestal formed by a pair of mutually closely spaced, substantially rigid posts 60 and 62 projecting vertically upwardly from an outer edge portion of the center panel 14, and further comprises an elongated, flexible strap 64 extending circularly from the upper end of the post 60 to the upper end of the post 62 and forming a finger-engageable pull-ring that is parallel to the center panel base 44. The base of each post 60 and 62 merges into the center panel 14 adjacent the inner margin of the web 16 and between the ends of the inner wall 52 of the raised body portion 46. With reference to FIGS. 2 and 3, the base of the post 62 can more particularly be seen to merge with the central panel base 44, the sloping portion of the peripheral wall 40, and the top surface 42 of the peripheral wall 40. The post 60 is likewise connected to the same parts of the center panel 14.

Referring to FIGS. 2 and 3, the radially outermost parts of the posts 60 and 62 form feet, designated 66 and 68 respectively, having radially outermost surfaces that slope downwardly and outwardly to their points of merger or connection to the outer margin of center panel 14 adjacent the inner margin of the web 16. The base portions of the feet 66 and 68 are rounded to form claws 70 and 72, the tips of which are immediately adjacent the inner margin of said web. The feet 66 and 68 project outwardly beyond the points of connection of the pull ring strap 64 to the posts 60 and 62. Accordingly, when one manually pulls on the pull-ring formed by the flexible strap 64, the pulling forces are transmitted by the posts 60 and 62 to base 44 of the center panel 14, thereby pulling on and distorting the shape of the center panel. In turn, shearing and tensional forces are applied to the web 16 to initiate severing of the web 16. The location of the claws 70 and 72 immediately adjacent the web 16 may enhance the shearing forces applied to the web 16. Thus, if one pulls primarily upwardly on the pull ring strap 64, causing the posts 60 and 62 to pivot about the claws 70 and 72, substantial stress is exerted on the web 16 enhanced by the leverage provided by the posts 60 and 62. Because of the feet 66 and 68, the pull ring strap 64 may be pulled either upwardly or rearwardly (away from the feet 66 and 68) to apply a stress to the web 16 that is partly in shear and partly in tension. Little effort is required to initiate rupture of the web 16 using the closure of this invention. By pulling back on the strap 64 after rupturing of the web 16 is initiated, as shown in FIG. 5, the entire web may also be ruptured and the center panel 14 separated from the outer rim 12 in one unbroken piece with little effort.

Closures of this invention can reliably resist accidental opening during assembly, handling, and shipping, but are relatively easy to intentionally open. Several factors are believed to contribute to the ease of opening. The posts 60 and 62 are sufficiently short and massive to be adequately rigid to initiate rupture of the web 16. In contrast, the thin-walled base 44 of the center panel 14 is relatively flexible and capable of distorting upwardly to accommodate the movements of the posts 60 and 62. The top of the strap 64 is substantially coplanar with the upper surface of the rim top wall 26. Although this is not needed to enable removal of the center panel, it is desirable that the strap 64 can be lifted and moved toward the outer rim 12 without engaging it before initiating rupture of the web. Similarly, the sloping outermost surfaces 66 and 68 of the posts 60 and 62 should be sufficiently spaced from the outer rim 12 that the posts 60 and 62 do not engage the outer rim 12 before the rupture of the web 16 is initiated. Otherwise, an engagement between the posts 60 and 62 with the outer rim 12 would interfere with the ability to apply a shearing force to the web 16 by movements of the posts.

Another factor contributing to the success of the closure is the location of the web 16 relative to the distal end of the inner rim wall 22. In the closure of this invention, the web 16 merges with the inner surface of the inner wall 22 intermediate its proximal and distal ends above the level of the sloping inner surface 34. Those familiar with the art will recognize that the construction of a mold used to produce the closure may be simplified by locating the web 16 as close to its distal or lower end as possible. However, it has been found that the location of the web 16 at the extreme distal end of the inner wall 22 may be unsatisfactory because the pulling forces exerted on the pull ring 64 to initiate rupture of the web 16 tend to cause the closure rim 12 to separate from the container, or may cause the container (if it is a composite container) to delaminate. The forces tending to cause separation of the closure from the container or delamination of the container ar minimized in accordance with this invention by so locating the web 16 that it merges with the inner surface of the inner wall 22 shortly above the level of the sloping inner surface 34. Thus, the web 16 is at a level wherein the inner wall 22 is welded to the container body 28 which is above the level of said inwardly sloping surface 34 so that any forces applied tending to cause removal of the closure or delamination of the container are applied directly to a welded part of the closure. If the web were connected to the outer rim at the distal end of the inner wall, the chamferred portion of the inner wall may act as a lever tending to cause closure removal or container delamination.

Figure 6:
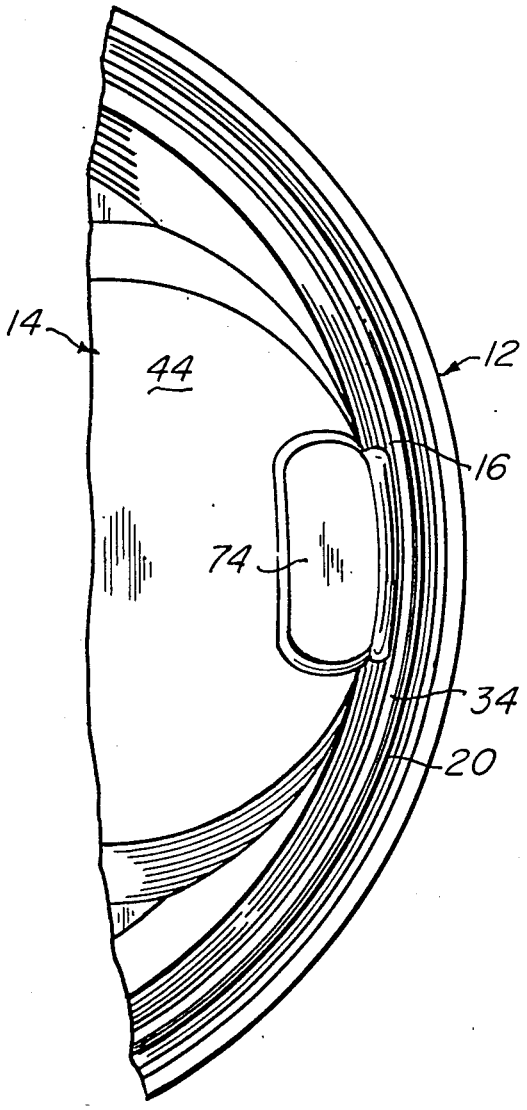
FIG. 6 is a fragmentary bottom plan view of the portion of the closure indicated by arrows 6—6 of FIG. 3, but on a scale smaller than FIG. 3.

With reference to FIGS. 3, 5 and 6, a pad 74 may be formed on the bottom surface of the center panel 14 underneath the posts 60 and 62. Thereby, the center panel 14 is made thicker in this area to avoid accidental rupture of the center panel 14 adjacent the posts 60 and 62 before intentional rupture of the web 16 as described above.

The closure 10 is symmetrical about a vertical plane extending diametrically through the closure 10 and the central panel base 44 and also extending midway between the posts 60 and 62. Accordingly, the web 16 may be expected to rupture in both circumferential directions starting from the posts 60 and 62. Here, it may be noted that a partial opening of the closure will be readily observable so that tampering will be evident.

The closure 10 comprises a one-piece body which may be injection molded from a suitable thermoplastic material. Although the invention is certainly not limited thereto, the material presently preferred is polyethylene because it is easily molded, readily available, inexpensive, relatively highly flexible, thin sections thereof are relatively easy to rupture, and polyethylene is capable of being spin welded.

In the practice of this invention with a composite container, the innermost layer, designated 28A, of the container body 28 is a plastic film to which the closure 10 is spin welded. Thus, the lugs 32 encircling the closure 10 are gripped by a spinning device (not shown) which is then spun at a high rate of speed, creating heat due to the frictional engagement between the confronting surfaces of the inner and outer walls 22 and 24 and the brim of the container body 28. Of course, the container body 28 and the outer rim 12 of the closure 10 must be circular for the spin welding operations to be possible. Sufficient heat is generated during the spinning operation to cause the plastic materials to partly melt and flow together to sealingly adhere the closure 10 to the plastic film 28A. As is conventional, the end of the container opposite the closure 10 is securely closed by a suitable means, such as the double-seamed sheet metal bottom plate, designated 80, shown in FIG. 5. Of course, the commodity to be stored is charged into the container body 28 before both ends are closed.

Figure 7:
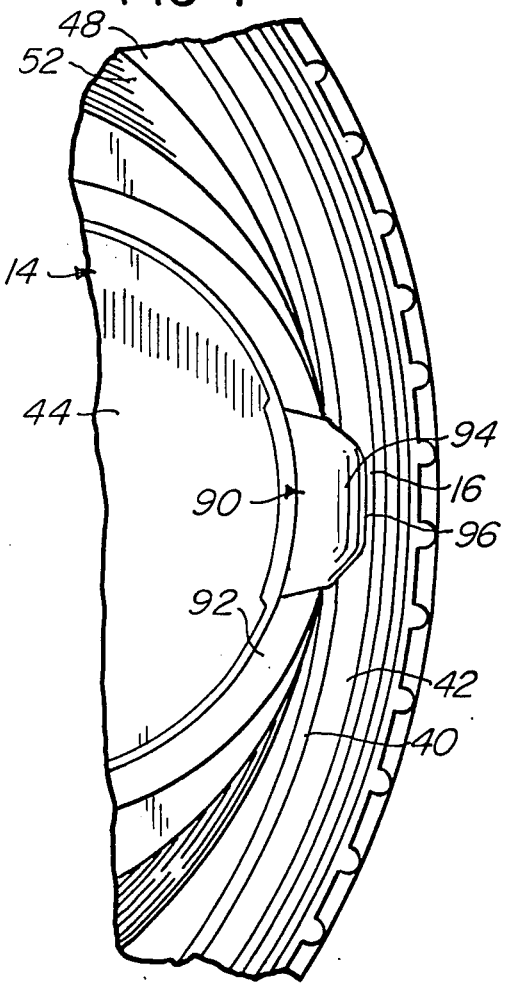
FIG. 7 is a fragmentary top plan view of a modified closure of this invention.

In the modification of FIG. 7, a single relatively rigid pedestal or post 90 is used to connect a pull ring strap 92 to the center panel portions 40, 42 and 44 instead of the two posts 60 and 62. The pedestal 90 has an outwardly projecting foot 94 with an outwardly and downwardly sloping outer surface. Foot 94 terminates at its lower end with a claw 96 bounding the web 16. Otherwise the embodiment of FIG. 7 may be the same as that of FIGS. 1–6, and like parts are given like reference numbers.

Closures of this invention may advantageously be used with container bodies having a diameter of approximately 2 inches to approximately 5 inches. Although the closures described above may be used with composite containers, it will be apparent that they may be used with other types of containers. Also, closures of this invention need not necessarily be circular but could be rectangular or other shapes to match the shapes of the containers with which they are to be used. Of course, they must be circular if they are to be applied to the containers by spin welding.

Although the preferred embodiments of this invention have been described, it will be understood that various changes ma be made within the scope of the appended claims.

Having thus described my invention, I claim:

1. A one-piece molded plastic closure comprising:

an outer rim having a generally horizontal top wall, an outer wall depending from said top wall, and an inner wall depending from said top wall, said walls defining a downwardly opening container brim-receiving channel for sungly receiving the brim of a container;

a thin-walled center panel having an outer periphery slightly smaller than the inner periphery of said inner wall;

a rupturable web connecting between the outer edge of said center panel and the inner surface of said inner wall of said rim around the entire periphery of said center panel; and means for removing said center panel in one unbroken piece from said rim comprising a relatively rigid pedestal projecting upwardly from said center panel adjacent its said outer periphery and flexible pull strap means connected to said pedestal, said pedestal having an outwardly projecting foot extending outwardly of the points of connection of said pull strap means to said pedestal.

2. The closure of claim 1 wherein said pedestal comprises a pair of mutually closely spaced, relatively rigid posts projecting upwardly from an outer edge portion of said center panel, said posts merging into said center panel adjacent the inner margin of said web.

3. The closure of claim 2 wherein said strap means comprises an elongate, flexible strap extending circularly from the upper end of one of said posts to the upper end of the other of said posts and forming a finger-engageable pull-ring, the upper ends of said posts being sufficiently spaced from said outer rim that one may pivot the posts toward said outer rim by pulling upwardly on said strap to apply sufficient stress to said web to initiate rupture of said web.

4. The closure of claim 1 wherein said center panel has an upwardly and outwardly sloping peripheral wall encircling a central panel portion, said peripheral wall terminating at its outer margin in said outer edge, said peripheral wall having a ring-shaped horizontal upper surface coplanar with the upper surface of said web, and wherein the base of said pedestal merges integrally with said central panel portion, the sloping portion of said peripheral wall, and said horizontal upper surface of said peripheral wall.

5. The closure of claim 1 wherein, for assistance in guiding said closure into assembled relation to a container, said outer wall has a distal end with an inner surface sloping outwardly and downwardly and said inner wall has a distal end with an outer surface sloping inwardly and downwardly.

6. The closure of claim 5 wherein said web merges with said inner surface of said inner wall of said rim below the proximal end thereof and above the level of said outer sloping surface thereof.

7. The closure of claim 1 wherein said pedestal has outermost surfaces sloping downwardly and outwardly to points of connection to said center panel at the outer margin of said center panel immediately adjacent the inner margin of said web.

8. The closure of claim 7 wherein, to optimize the stress applied to said web as said posts are pivoted, the outermost base portion of each of said posts forms a rounded claw, the tip of which is immediately adjacent the inner margin of said web.

9. The closure of claim 1 wherein said outer wall of said rim has means for driving engagement to a spinning mechanism comprising at least one bead at said outer wall.

10. A container comprising:

a one-piece molded plastic closure comprising:

a substantially cylindrical outer rim having a circular, generally horizontal top wall, a substantially cylindrical outer wall depending from said top wall, and a substantially cylindrical inner wall depending from said top wall, said walls defining a downwardly opening, annular, container brim-receiving channel for sungly receiving the brim of a container;

a thin-walled, circular center panel having an outer diameter slightly smaller than the inner diameter of said inner wall;

a circular, rupturable web connecting between the outer edge of said center panel and the inner surface of said inner wall of said rim; and means for removing said center panel in one unbroken piece from said im comprising a relatively rigid pedestal projecting upwardly from said center panel adjacent its said outer periphery and flexible pull strap means connected to said pedestal, said pedestal having an outwardly projecting foot extending outwardly of the points of connection of said pull strap means to said pedestal; and a tubular composite container body having one end spin welded in said container brim-receiving channel of said closure.

11. The container of claim 10 wherein said pedestal comprises a pair of mutually closely spaced, relatively rigid posts projecting upwardly from an outer edge portion of said center panel, said posts merging into said center panel adjacent the inner margin of said web, and said strap means comprises an elongate, flexible strap extending circularly from the upper end of one of said posts to the upper end of the other of said posts forming a finger-engageable pull-ring, the upper ends of said posts being sufficiently spaced from said outer rim that one may pivot the posts toward said outer rim by pulling upwardly on said strap to apply sufficient stress to said web to initiate rupture of said web.

12. The container of claim 10 wherein said center panel has an upwardly and outwardly sloping peripheral wall encircling a central panel portion, said peripheral wall terminating at its outer margin in said outer edge, said peripheral wall having a ring shaped horizontal upper surface coplanar with the upper surface of said web, and wherein the base of said pedestal merges integrally with said central panel portion, the sloping portion of said peripheral wall, and said horizontal upper surface of said peripheral wall.

13. The container of claim 10 wherein said web merges with said inner surface of said inner wall of said rim intermediate the proximal and distal ends thereof.

14. The container of claim 10 wherein, for assistance in guiding said closure into assembled relation to a container, said outer wall has a distal end with an inner surface sloping outwardly and downwardly and said inner wall has a distal end with an outer surface sloping inwardly and downwardly.

15. The container of claim 10 wherein said pedestal has outermost surfaces sloping downwardly and outwardly to points of connection to said center panel at the outer margin of said center panel immediately adjacent the inner margin of said web.

16. The container of claim 15 wherein, to optimize the stress applied to said web as said posts are pivoted, the outermost base portion of each of said posts forms a rounded claw, the tip of which is immediately adjacent the inner margin of said web.

17. The container of claim 10 wherein said outer wall of said rim has means for driving engagement to a spinning mechanism comprising at least one bead at said outer wall.

* * * * *

UNITED STATES PATENT AND TRADEMARK OFFICE

CERTIFICATE OF CORRECTION

PATENT NO. : 4,702,387

DATED : October 27, 1987

INVENTOR(S) : Harry A. E. Wombold

It is certified that error appears in the above-identified patent and that said Letters Patent is hereby corrected as shown below:

Column 2, line 42, "s" should be --so--. Column 4, line 22, "that portion" should be --that a portion--; column 4, line 42, "plan as" should be --plan, as--. Column 6, line 10, "ar" should be --are--. Column 7, line 20, "ma" should be --may--. Claim 10, line 18 (Column 8, line 42), "im" should be --rim--. Claim 12, line 5 (column 9, line 1), "ring shaped" should be --ring-shaped--.

Signed and Sealed this

Fifth Day of March, 1991

*Attest:*

HARRY F. MANBECK, JR.

*Attesting Officer*

*Commissioner of Patents and Trademarks*